US005517286A

United States Patent [19]

Tada et al.

[11] Patent Number: 5,517,286

[45] Date of Patent: May 14, 1996

[54] DEVELOPING APPARATUS

[75] Inventors: Tatsuya Tada, Yokohama; Isami Itoh, Kawasaki, both of Japan

[73] Assignee: Canon Kabushiki Kaisha, Tokyo, Japan

[21] Appl. No.: 187,872

[22] Filed: Jan. 28, 1994

[30] Foreign Application Priority Data

| | | | |
|---|---|---|---|
| Jan. 28, 1993 | [JP] | Japan | 5-032685 |
| Feb. 3, 1993 | [JP] | Japan | 5-037366 |
| May 19, 1993 | [JP] | Japan | 5-139167 |

[51] Int. Cl.[6] ..... G03G 15/09

[52] U.S. Cl. ..... 355/251; 118/656; 118/657; 118/658; 355/253

[58] Field of Search ..... 355/251, 253; 118/656–658

[56] References Cited

U.S. PATENT DOCUMENTS

| | | | |
|---|---|---|---|
| 2,217,691 | 10/1940 | Mason . | |
| 2,297,691 | 10/1942 | Carlson . | |
| 2,874,063 | 2/1959 | Greig . | |
| 3,909,258 | 9/1975 | Kotz . | |
| 4,387,664 | 6/1983 | Hosono et al. . | |
| 4,464,041 | 8/1984 | Haneda et al. | 118/653 X |
| 4,502,412 | 3/1985 | Jones | 118/658 |
| 4,585,326 | 4/1986 | Okamoto et al. | 118/657 X |
| 4,624,559 | 11/1986 | Haneda et al. . | |
| 4,746,952 | 5/1988 | Kusuda et al. | 118/657 X |
| 5,054,419 | 10/1991 | Itaya et al. | 118/657 |
| 5,184,187 | 2/1993 | Haneda et al. | 355/251 X |

FOREIGN PATENT DOCUMENTS

| | | | |
|---|---|---|---|
| 17-23910 | 11/1942 | Japan . | |
| 18-24748 | 10/1943 | Japan . | |
| 52-94140 | 8/1977 | Japan . | |
| 54-43036 | 4/1979 | Japan . | |
| 0068758 | 4/1983 | Japan | 355/253 |
| 0217966 | 12/1983 | Japan | 355/253 |
| 0064674 | 3/1990 | Japan | 355/253 |
| 0064675 | 3/1990 | Japan | 355/253 |
| 0343376 | 11/1992 | Japan | 355/253 |

*Primary Examiner*—Matthew S. Smith
*Attorney, Agent, or Firm*—Fitzpatrick, Cella, Harper & Scinto

[57] ABSTRACT

A stationary magnet is disposed in a developing sleeve for carrying a one component magnetic developer. A regulating sleeve for regulating a layer of the developer is disposed opposed to the developing sleeve. The regulating sleeve rotates in the same direction as the developing sleeve. In the regulating sleeve, there is disposed a magnet or magnetic member cooperative with the stationary magnet to form a magnetic field in a gap between the developing sleeve and the regulating sleeve.

30 Claims, 12 Drawing Sheets

DEVELOPING APPARATUS

FIELD OF THE INVENTION AND RELATED ART

The present invention relates to a developing apparatus usable with an image forming apparatus such as an electrophotographic or electrostatic recording apparatus.

Heretofore, various electrophotographic processes are known as disclosed in U.S. Pat. No. 2,297,691, Japanese Patent Application Publication No. 23910/1967, Japanese Patent Application Publication No. 24748/1968. Also, various developing apparatuses for developing electrostatic latent images are known, as disclosed in U.S. Pat. Nos. 2,874,063, 2,217,691, 3,909,258, Japanese Laid-Open Patent Application No. 94140/1977, Japanese Laid-Open Patent Application No. 43036/1979, or the like. The present invention mainly relates to a developing apparatus usable with a magnetic one component developer (magnetic toner).

Referring first to FIG. 10 there is shown an example of a conventional apparatus. As shown in FIG. 1, the developing device comprises a developer container 3 for containing a magnetic toner T which is a magnetic one component developer. In the developer container 3, a developing sleeve 1*a* is disposed for rotation in the direction indicated by an arrow to an opening faced to a photosensitive drum 100 as a recording material. The developing sleeve 1*a* is composed of non-magnetic material, and in the sleeve 1*a*, a stationary magnet 1*b* is disposed stationarily. At the rear position the developer container 3, there is disposed a developer feeding member 4. Above the developing sleeve 1*a* in the opening of the developer container 3, a magnetic blade 2 is disposed opposed to one magnetic pole N of the magnetic-poles of the magnet 1*b* in the developing sleeve 1*a*, by which a developer regulating station is constituted. The magnetic blade 2 is disposed so that the clearance or gap between the blade 2 and the developing sleeve 1*a* is constant W. Generally, the clearance W is 100 μm–1 mm, as disclosed in U.S. Pat. No. 4,387,664.

The magnetic toner in the developer container is carried on the developing sleeve 1*a* by the magnet 1*b*. By the rotation of the developing sleeve 1*a*, it is carried to a developing zone where the developing sleeve 1*a* is faced to the photosensitive drum 100. During the carrying motion, the developer is regulated by the magnetic blade 2 in the regulating station, that a thin layer of the toner T is formed on the developing sleeve 1*a*. The thickness of the toner layer, as shown in FIG. 3, is determined by a position of a cutting line L extending in parallel with the surface of the developing sleeve 1*a* between the developing sleeve 1*a* and the magnetic blade 2. The cutting line L will be described in detail hereinafter. The investigations of the inventors have revealed the following charge application, toner conveyance and toner behavior when the magnetic toner T passes through the gap between the developing sleeve 1*a* and the magnetic blade 2.

As shown in FIG. 2, two planes are considered which are perpendicular to a line connecting the developing sleeve 1*a* and the magnetic blade 2. The plane closer to the magnetic blade 2 is called α1, and the one closer to the developing sleeve 1*a* is α2. Generally, the width of the magnetic blade (measured along the circumference of the developing sleeve 1*a*) is narrower than the width of the magnetic pole N of the magnet 1*b*, and therefore, the magnetic flux density of the magnetic field formed by the magnetic pole N of the magnet 1*b* in the plane α1 is larger than that in plane α2. For this reason, the magnetic toner T carried on the developing sleeve 1*a* receives the magnetic force converging to the magnetic blade 2, as shown by arrows in FIG. 2, between the developing sleeve 1*a* and the magnetic blade 2.

As a result, between the developing sleeve 1*a* and the magnetic blade 2, the magnetic toner T forms chains from the magnetic blade 2 toward the developing sleeve 1*a*, as indicated by B in FIG. 3. The toner t1 at the free end of the chain is in contact with the developing sleeve 1*a*, so that the magnetic toner T is triboelectrically charged at the end portions of the chains.

The toner t1 at the end portions thus is triboelectrically charged by contact with the developing sleeve 1*a* to a polarity effective to develop the latent image, is retained on the developing sleeve 1*a* by electrostatic mirror force, and receives a conveying force by the friction with the developing sleeve 1*a* in the same rotational direction as the developing sleeve 1*a*. At this time, there are cohesive forces to some extent among toner particles, and therefore, the conveying force is applied through the cohesive force to toner t2 in the second layer in contact with the toner t1 (toner in the first layer) at the end portions of the chains. Similarly, the conveying force is applied through the cohesive force to toner t3 in the third layer thereabove.

However, between the developing sleeve 1*a* and the magnetic blade 2, the magnetic force is applied toward the magnetic blade 2. Accordingly, there is a plane where the conveying force applied to the toner overcomes the magnetic force. This plane is defined as a cutting line L in FIG. 3. Then, the chains of the toner are torn at the cutting line L, and the toner on the side of the developing sleeve 1*a* is conveyed in the rotational direction of the developing sleeve 1*a*.

As regards the toner particles which have not received a sufficient electric charge and which remain on the magnetic blade 2, as shown in FIG. 3 by A, the stagnated remaining toner increases with operation to such an extent that the toner particles can not be retained on the magnetic blade 2 by magnetic force thereof. Then, the insufficiently charged toner is removed from the magnetic blade 2 and is conveyed in the rotational direction of the developing sleeve 1*a*.

The above is the mechanism of the charge application and the toner conveyance and the toner behavior when the magnetic toner T passes through the clearance between the developing sleeve 1*a* and the magnetic blade 2.

As will be understood, a sufficient triboelectric charge can be applied only to the toner t1 in the first layer on the developing sleeve 1*a*. and therefore, a part of the toner particles conveyed by The developing sleeve 1*a* is occupied by insufficiently charged toner particles. As a result, the developing action is not stable because of the instability in the toner charge, and therefore, sufficient images are not stably formed.

SUMMARY OF THE INVENTION

Accordingly, it is a principal object of the present invention to provide a developing apparatus which can stably provide satisfactory developed images using one component magnetic developer.

It is another object of the present invention to provide a developing apparatus in which one component magnetic developer triboelectrically charged in good order can be conveyed to a developing zone where a latent image is developed.

It is a further object of the present invention to provide a developing apparatus in which the one component developer which is insufficiently triboelectrically charged is prevented from being conveyed out.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

Figure 4:
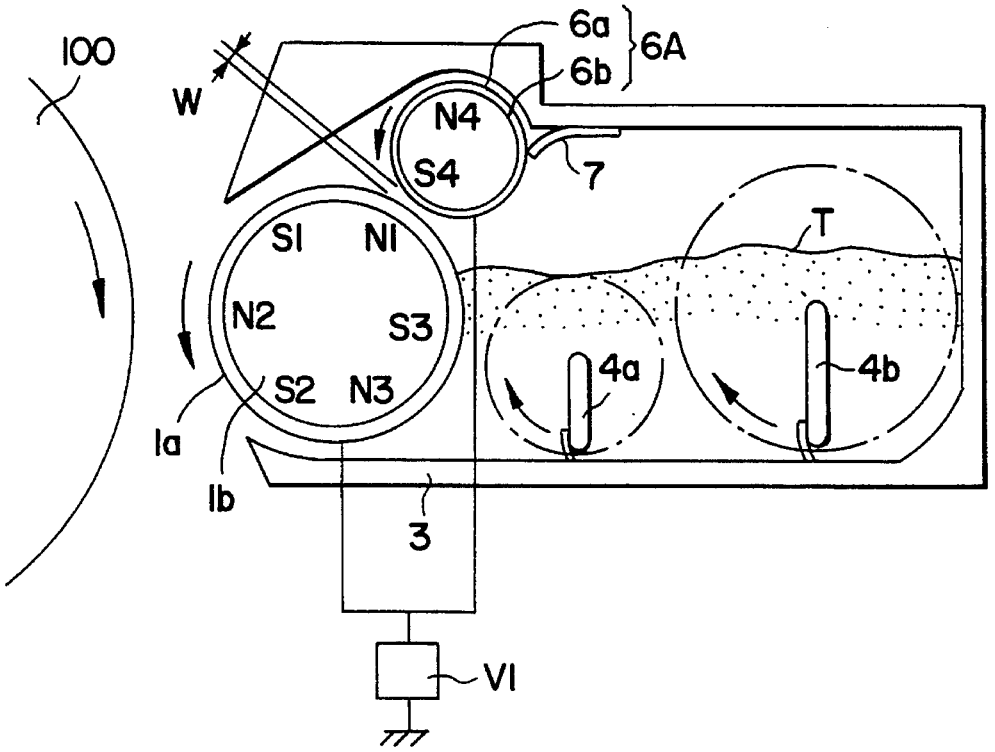
FIG. 4 is a sectional view of a developing apparatus according to an embodiment of the present invention.

Referring to FIG. 4, there is shown in cross-section a developing apparatus according to an embodiment of the present invention. The developing apparatus comprises a developer container 3 for containing magnetic toner T which is magnetic one component developer having an electrically insulative property. The developer container 3 is provided with an opening at a position faced to an electrophotographic photosensitive drum 100 rotatable in a direction indicated by an arrow, in which a developing sleeve 1*a* for receiving the magnetic toner T in the container 3 is disposed for rotation in the direction indicated by an arrow. The developing sleeve 1*a* is of non-magnetic material such as aluminum or the like, and a stationary magnet roller 1*b* is disposed therein. At a rear position of the developer container 3, two developer feeding members 4*a* and 4*b* are juxtaposed for conveying the magnetic toner T to the developing sleeve 1*a* in the container 3 by the rotations thereof indicated by the arrows.

In this embodiment, a developer regulating means 6A comprising a regulating sleeve 6*a* of non-magnetic material such as aluminum or the like and a stationary magnet roller 6*b* therein, is disposed close to the developing sleeve 1*a* at a position upstream of a developing zone where the developing sleeve 1*a* is opposed to the photosensitive drum 100, with respect to the rotational direction of the developing sleeve 1*a*. The regulating sleeve 6*a* is rotatable in the direction indicated by an arrow, that is, in the same direction as the developing sleeve 1*a*. In other words, the peripheries of the sleeves 1*a* and 6*a*, are moved in opposite directions at the portion where they are closest with each other.

The developing sleeve 6*a* is contacted by a non-magnetic and elastic scraper 7 for removing the toner therefrom.

In the illustrated example, the magnet roller (permanent magnet) 1*b* stationarily disposed in the developing sleeve 1*a* has six magnetic poles S1, S2, S3, N1, N2 and N3. Here, "S" means S-pole, and "N" means N-pole.

The magnetic pole N2 is a developing pole for forming a magnetic field in the developing zone, and is disposed at a position where the sleeve 1*a* and the photosensitive drum 100 is closest.

Magnetic pole N1 has a function of regulating the layer of toner particles in cooperation with the regulating member 6*a*, as will be described hereinafter in detail.

The other poles S1, S2, S3 and N3 function to magnetically attract the toner onto the sleeve 1*a*, and to assist the feeding of the toner by the rotation of the sleeve 1*a*.

On the other hand, in the illustrated example, a magnet roller (permanent magnet) 6*b* stationarily disposed in the regulating sleeve 6*a*, has two magnetic poles S4 and N4.

The magnetic pole S4 of a polarity opposite from that of the magnetic pale N1 is formed at such a position that the magnetic poles are magnetically attracted to each other. Therefore, the magnetic lines of force are continuous between these magnetic poles, so that a strong magnetic field is formed in the gap between the sleeves 1*a* and 6*a* and between the magnetic poles N1 and S4.

Here, "two magnetic poles are faced" means as follows in this Specification.

Referring to FIG. 4, the magnet roller 1*b*, for example, is fixed at a position indicated in the Figure by magnetic pole N1. On the other hand, the magnet roller 6*b* is supported for rotation about its central axis. Then, the magnet roller 6*b* is rotated to such a position that it is stopped by the magnetic attraction force between the magnetic poles S4 and N1. This state in which the magnet roller 6*b* is stationary by the magnetic attraction force, means that the magnetic poles N1 and S1 are faced or opposed to each other.

In any case, the magnetic field formed between the magnetic poles N1 and S1 is effective to constrain passage of the magnetic toner through the gap between the sleeves 1*a* and 6*a*, that is, the regulating station. Since the regulating sleeve 6*a* is rotated in the same direction as the developing sleeve 1*a*, a friction force is applied to the toner contacted to the sleeve 6*a* by the function of the magnetic field, so that a conveying force is applied in the direction of the rotating motion of the regulating sleeve 6*a* (the conveying force in the direction opposite from the conveying direction by the developing sleeve 1*a*) is applied. This conveying force is transmitted to the toner away from the regulating sleeve 6*a* by the friction or cohesive force existing among the toner particles. As a result, the toner in the regulating station receives the conveying force in the rotational direction of the sleeve 6*a* from the regulating member 6A, that is, the conveying force toward the inside of the container 3.

As described hereinbefore, to the magnetic toner in the first layer in contact with the developing sleeve 1*a*, an electric charge is applied by the triboelectric charging with the developing sleeve 1*a*. By the mirror force produce by the electric charge, the toner is attracted on the developing sleeve 1*a*, and by the friction with the developing sleeve 1*a*, the toner receives the conveying force in the same direction as the rotation of the developing sleeve 1*a*.

Figure 5:
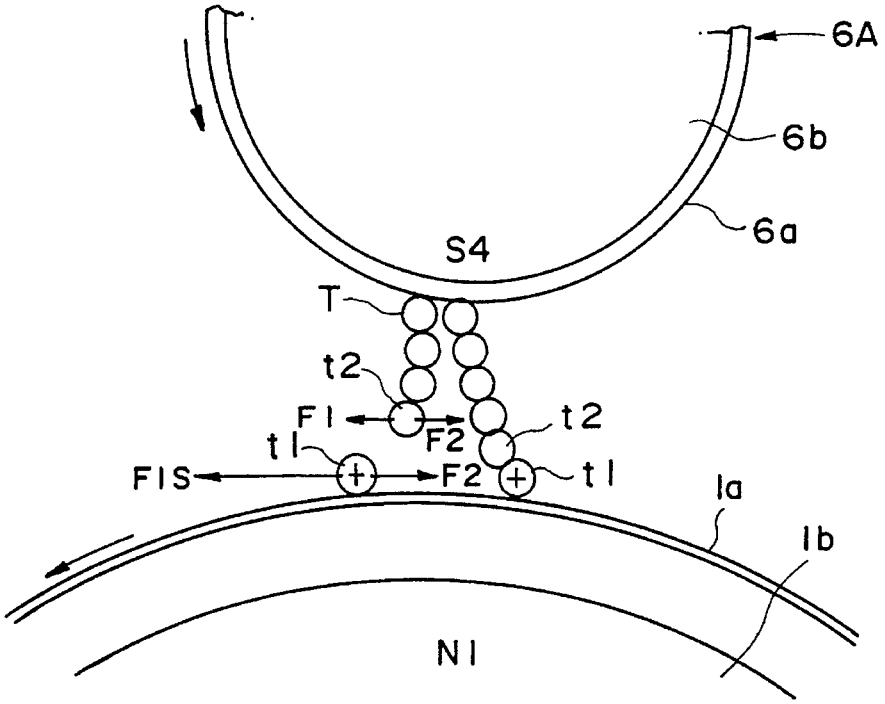
FIG. 5 is a sectional view illustrating the operation mechanism in the apparatus of the embodiment.

Accordingly, as shown in FIG. 5, the toner t1 in the first layer, in contact with the developing sleeve 1*a*, among the magnetic toner particles T existing in the developer regulating station between the sleeve 6*a* and the developing sleeve 1*a*, receives the feeding force (F1*s*) in accordance with the amount of the charge of the toner T1 from the developing sleeve 1*a*, and a conveying force (F2) from the regulating means 6A (sleeve 6*a*), as the major conveying forces.

Accordingly, if the following conditions are satisfied, then only the toner in the first layer which has been sufficiently charged by contact with the developing sleeve 1*a*, is fed into the developing zone:

$$F1<F2 \quad (1)$$

$$F2<F1s \quad (2)$$

On the other hand, the insufficiently charged toner particles separated from the toner particles in the first layer, are pushed back into the container 3 by the rotation of the regulating sleeve 6*a*. The toner returned into the container is applied again onto the developing sleeve 1*a*.

It is preferable that the 50% level width of the magnetic pole S4 is smaller than the 50% level width of the magnetic pole N1. By doing so, the magnetic flux density of the magnetic field formed between the magnetic pole N1 and the magnetic pole S4 can be increased toward the regulating member 6A from the developing sleeve 1*a*. Then, the toner conveying force by the regulating sleeve 6*a* can be increased.

Figure 6:
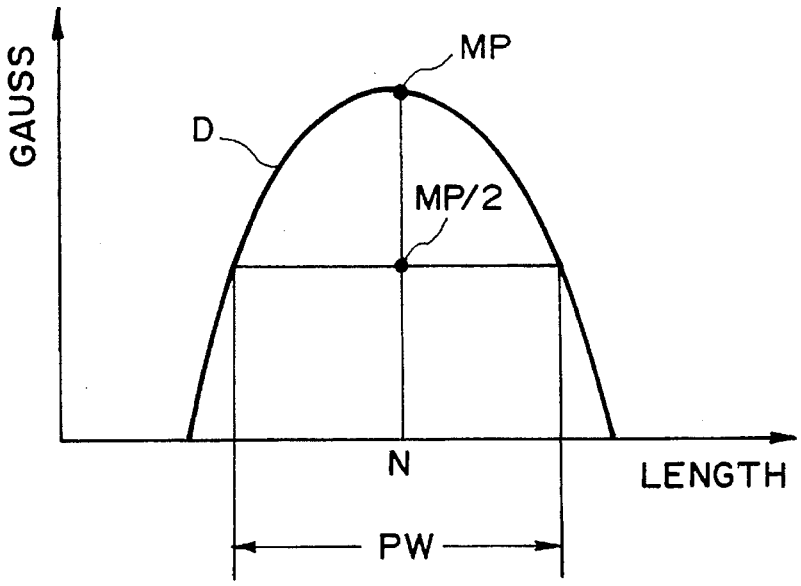
FIG. 6 is a graph illustrating a 50% level width of a magnetic pole.

Here, the 50% level width PW of the magnetic pole of the magnet means a width PW of the magnetic flux density distribution D provided by the magnetic pole N at the level of 50% (MP/2) of the peak (MP) in the distribution D, in the state that there is no magnet or magnetic member adjacent the magnet (FIG. 6). The 50% width level may be called a half-peak width.

In this embodiment, the magnetic flux density of the magnetic pole N1 of the magnet 1*b* in the developing sleeve 1*a* is 900 Gauss; the magnetic flux density of the magnetic pole S4 of the magnet 6*b* in the sleeve 6*a* of the regulating member 6A is 800 Gauss, and a ratio of the 50% level widths of the magnetic poles N1 and S4, is as follows:

$$(50\% \text{ level width of the magnetic pole } S4)/(50\% \text{ level width of the magnetic pole } N1)\approx 0.8$$

Thus, the width of the magnetic pole S4 is narrower than that of the magnetic pole N1, by which the magnetic flux density of the magnetic field formed between the magnetic poles N1 and S4 is increased from the developing sleeve 1*a* toward the regulating member 6A.

The minimum distance W between the regulating sleeve 6*a* and the developing sleeve 1*a* is approx. 500 μm, and the peripheral speed of the developing sleeve la is made equal to the peripheral speed of the sleeve 6*a*.

Under the above-described conditions, magnetic toner powder containing 10% by weight or higher magnetic material in a resin binder and having a weight average particle size of not less than 5 μm, was used. As a result, it has been confirmed that the above inequations (1) and (2) are satisfied.

Accordingly, in this embodiment, only the sufficiently charged toner particles can be conveyed into the developing zone, and therefore, the developing operations are stabilized, thus providing satisfactory images.

In the developing zone, the thickness of toner layer on the developing sleeve 1*a* is smaller than the minimum gap between the drum 100 and the sleeve 1*a*. Therefore, the toner particles on the sleeve 1*a* jump to the drum 100 to develop the electrostatic latent image. In order to increase the development efficiency in such a so-called non-contact type development, the developing sleeve 1*a* is supplied with an oscillating bias voltage in the form of an AC biased DC voltage, from a voltage source V1. The developing sleeve 1*a* may be supplied with a DC bias voltage.

In the example of FIG. 4, the regulating sleeve 6*a* is also supplied with the bias voltage which is the same as the bias voltage applied to the developing sleeve 1*a*.

In the foregoing, an example of this embodiment has been described. However, the present invention is not limited to this example. The magnetic flux densities of the magnetic poles S4 and N1, the 50% level widths of them, the gap W between the regulating sleeve 6*a* and the developing sleeve 1*a*, the peripheral speeds of the sleeve 6*a* and the developing sleeve 1*a*, or the like, are properly determined by one skilled in the art in accordance with the properties of the magnetic toner particles to be used, so as to satisfy the inequations (1) and (2).

Embodiment 2

Depending on the properties of the magnetic toner to be used, the distribution of the charge amount of the toner vary widely. In such an occasion, the conveying force F1*s* depending on the charge amount, which is applied to The toner in the first layer from the developing sleeve 1*a*, different with a certain distribution.

Where an average conveying force F1*s* (influenced by the charge amount) applied from the developing sleeve 1*a* to the toner contacted thereto is not so strong, as compared with the conveying force F1 applied from the developing sleeve 1*a* to the toner not contacted thereto, the strengths of the conveying force F1*s* and the conveying force F2 are reversed so as not to satisfy the inequation (2) (F2<F1*s*), if the conveying force F2 from the regulating member 6A is selected to satisfy the inequation (1) (F1<F2).

Accordingly, in this embodiment, a voltage of the same polarity as the polarity of the charge of the toner is applied to the regulating sleeve 6*a* from a voltage source V2 so that an electric field effective to urge the toner between the developing sleeve 1*a* and the regulating sleeve 6*a* to the developing sleeve 1*a* is produced, by which an electric force is applied to the toner in the chains by the produced electric field from the regulating member 6A toward the developing sleeve 1*a*.

As a result, the toner in the first layer is urged strongly to the developing sleeve 1*a* with the result of the increased friction force, and therefore, the conveying force F1*s* is increased. In this manner, the equations (1) and (2) are easily satisfied.

For this embodiment, the same experiments as in Embodiment 1 have been carried out, except that the sleeve 6*a* of the regulating member 6A is supplied with a DC voltage of approx. 500 V (absolute value).

As a result, it has been confirmed that the equations (1), (2) are satisfied also in this embodiment, and only the toner sufficiently charged is conveyed into the developing zone. Therefore, the developing operation is stabilized, and satisfactory images have been produced.

In the foregoing, the approx. 500 V voltage (absolute value) is applied to the sleeve 6*a*, but the voltage level may be properly selected depending on the properties of the magnetic toner or the like. The applied voltage is not limited to DC, but may be an AC voltage or an AC biased DC voltage.

Embodiment 3

Figure 8:
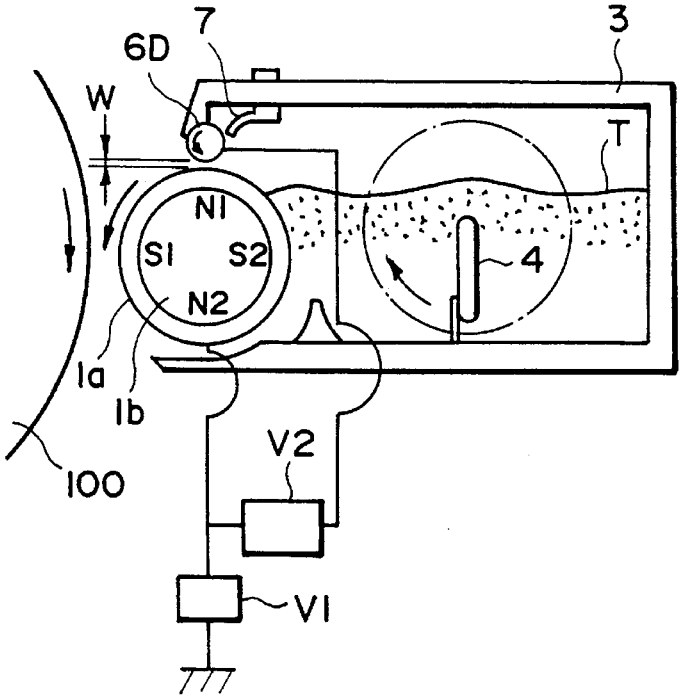
FIG. 8 is a sectional view of a developing apparatus according to a further embodiment of the present invention.

FIG. 8 is a sectional view of an apparatus according to a further embodiment. In this embodiment, use is made of a regulating roller 6D of magnetic material such as iron or the like which is magnetized by induction as the developer regulating member disposed opposed to the developing sleeve. The regulating roller 6D is disposed in the magnetic field formed by the magnetic pole N1 and is disposed opposed to the magnetic pole N2 of the magnet 1*b* in the developing sleeve 1*a*. it is rotated in the same direction as the developing sleeve 1*a*. The diameter of the regulating roller 5D is made smaller than the 50% level width of the magnetic pole N1, so that the magnetic flux density between the magnetic pole N1 and the regulating roller 6D increases toward the regulating roller 6D.

More particularly, the magnetic flux density of the magnetic pole N1 of the magnet 1*b* is 1000 Gauss; and the ratio of the diameter of the regulating roller 6D relative to the 50% level width of the magnetic pole N1 is as follows:

(diameter of the regulating roller 6*D*)/(50% level width of the magnetic pole *N*1)<0.4

By doing so, the magnetic flux density between the magnetic pole N1 and the regulating roller 6D is made larger adjacent the regulating roller 6D.

The distance W between the regulating roller 6D and the developing sleeve 1*a* is approx. 0.3 mm, and the peripheral speeds of the developing sleeve 1*a* and the regulating roller 6D are the same. The roller 6D is supplied with a DC voltage of approx. 300 V (absolute value). In other respects, the apparatus is the same as that in Embodiment 1.

As a result, also in this embodiment, similarly to Embodiment 2, the above-described relations (1) and (2) were easily satisfied, so that only the sufficiently charged toner is conveyed into the developing zone, by which the developing operation is stabilized to form satisfactory images.

In the foregoing, approx. 300 V (absolute value) is applied to the radiating roller 6D functioning as the regulating member, but the voltage level can be properly determined in accordance with the properties of the magnetic toner particles or the like. The applied voltage may be DC, AC or DC biased AC.

Similarly to Embodiment 1, the voltage V2 may be omitted.

Embodiment 4

Figure 9:
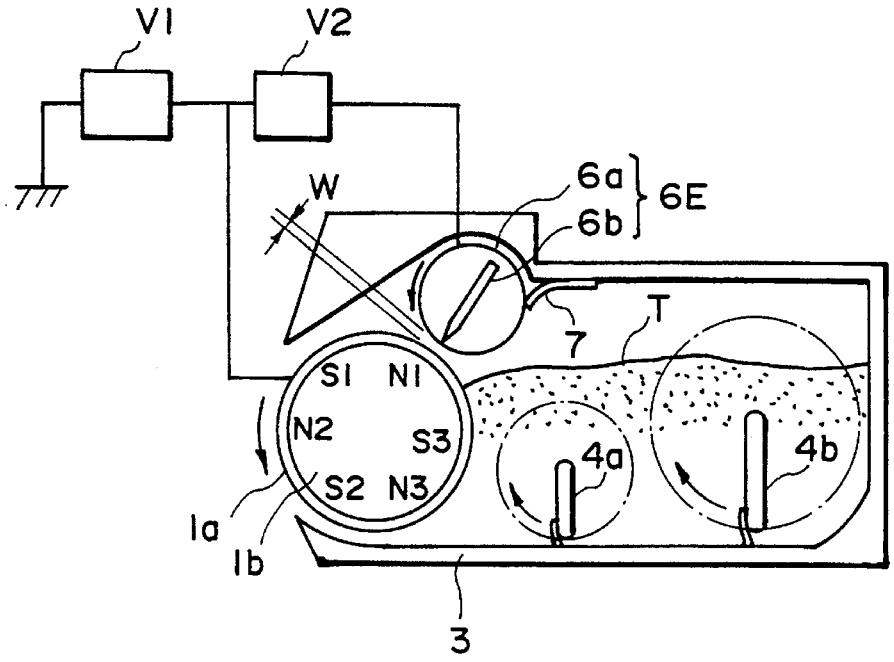
FIG. 9 is a sectional view of a developing apparatus according to a yet further embodiment of the present invention.

FIG. 9 is a sectional view of a developing apparatus according to a further embodiment of the present invention. In this embodiment, the developer regulating means 6E comprises a regulating sleeve 6*a* of non-magnetic material such as aluminum and a stationary magnetic plate 6*b* of iron or the like which is magnetized by induction in a magnetic field, and a free end of the magnetic plate 6*b* is opposed to the sleeve 1*a*. Preferably, the end faced to the sleeve 1*a* is sharpened as shown in FIG. 9, and is opposed to the magnetic pole N1 in the developing sleeve 1*a*. The magnetic plate 6*b* is in the magnetic field provided by the magnetic pole N1. The thickness of the magnetic plate 6D is smaller than the 50% level width of the magnetic pole N1 opposed to the magnet 1*b* so that the magnetic flux density between the magnetic pole N1 and the magnetic plate 6*b* is increased toward the sleeve 6*a*.

More particularly, the magnetic flux density of the magnetic pole N1 of the magnet 1*b* is 1000 Gauss; and a ratio of the thickness of the magnetic plate 6D to the 50% level width of the magnetic pole N1 is as follows:

(thickness of the magnetic plate 6*b*)/(50% level width of the magnetic pole *N*1)<0.4

By doing so, the magnetic flux (density between the magnetic pole N1 and the magnetic plate 6*b* is larger at the magnetic plate 6*b* side.

The distance W between the sleeve 6*a* and the developing sleeve 1*a* is approx. 0.25 mm, and the peripheral speeds of the developing sleeve 1*a* and the sleeve 6*a* are the same. The sleeve 6*a* is supplied with approx. 300 V DC voltage (absolute value). In other respects, the same as in Embodiment 1 was used.

As a result, also in this embodiment, similarly to Embodiment 2, the relations (1) and (2) are easily satisfied. Similarly to all of the foregoing embodiments, a sufficient amount only of the toners sufficiently charged, can be conveyed to the developing zone, so that the developing operation can be carried out with stability to provide satisfactory images. As compared with the embodiment of FIG. 8, the magnetic flux density at the developing position can be further enhanced.

In the foregoing, the sleeve 6*a* (regulating member 6E) is supplied with a voltage of approx. 300 V (absolute value), but the voltage level can be properly adjusted in accordance with the properties of the magnetic toner or the like. The applied voltage may be DC, AC or DC biased AC.

In this embodiment, the magnetic field formed by the magnetic pole N1 is concentrated more strongly at the magnetic plate 6*b*, and therefore, the toner conveying force by the regulating sleeve 6*a* enhanced.

Embodiment 5

This embodiment is a modification of Embodiment 1 (FIG. 4) by providing rotation control means (not shown) for the developing sleeve 1*a* to make the peripheral speed of the developing sleeve 1*a* larger than that of the photosensitive drum 100.

Generally, in order to provide sufficient image density by the development, an amount of toner not less than one dense layer of the toner exists over the surface of the developing sleeve. The amount of the toner which can be sufficiently triboelectrically charged with the friction with the developing sleeve is approximately the one dense layer toner on the developing sleeve. Accordingly, in order to provide sufficient image density, it is desirable that the one dense layer of the toner particles be formed on the developing sleeve, so that the toner particles are sufficiently charged, and all of such toner particles are fed into the developing zone.

Most of the magnetic toners investigated by the inventors were satisfactory in the dense application, sufficient charging and the conveyance of all of the toner particles into the developing zone, are satisfied. However, they are not satisfied as the case may be.

As described hereinbefore, the charge amount of the toner has a certain distribution. When the average conveying force F1*s* (influenced by the charge amount) applied from the developing sleeve 1*a* to the toner conducted thereto is not so strong, the strengths of the conveying force F1*s* and the conveying force F2 are reversed with the result that the relation (2), (F2≦F1*s*) is not satisfied, if the conveying force F2 from the regulating member 6A in FIG. 4 is selected so as to satisfy the relation (1), (F1<F2).

In this occasion, the amount of toner actually conveyed into the developing zone is necessarily decreased relative to the amount of magnetic toner sufficiently charged by triboelectricity with the developing sleeve, with the result that the necessary amount of toner can not be supplied into the developing zone.

In order to solve this problem, in this embodiment, the peripheral speed of the developing sleeve 1 is made larger than that of the photosensitive drum 100, as described hereinbefore. In this case, it has been found that the following condition is particularly preferable:

$$\text{(peripheral speed of the developing sleeve)/(peripheral speed of the photosensitive drum)} \geqq 0.06\, R\rho/m \quad (3)$$

where R (μm) is a weight average particle size of the magnetic toner, ρ (g/cm$^3$) is true density, and m (mg/cm$^2$) is an amount of the developer on the developing sleeve in the developing zone.

This embodiment is the same as Embodiment 1 in other respects. The peripheral speed of the developing sleeve 1*a* is not less than approx. 1.5 times the peripheral speed of the photosensitive drum 100.

With the foregoing conditions, similarly to Embodiment 1, the magnetic toner having the content of magnetic material not less than 10% by weight, and a weight average particle size not less than 5 μm, was used. It has been confirm that the above-described relations (1), (2) and (3) are satisfied.

As a result, in this embodiment, a sufficient amount of only toners sufficiently charged can be conveyed into the developing zone, so that the developing operation is stabilized to provide satisfactory images of high density.

This embodiment may be combined with any of Embodiments 2–4, so that the developing sleeve is rotated at a higher peripheral speed than that of the photosensitive drum so as to satisfy relation (3). By doing so, higher density images can be provided.

Embodiment 6

Figure 1:
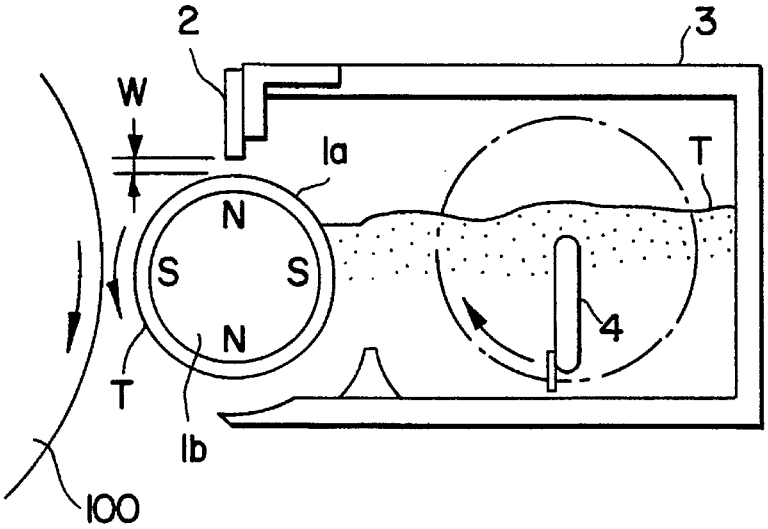
FIG. 1 (PRIOR ART)
FIG. 1 is a sectional view of a conventional developing machine.
Figure 2:
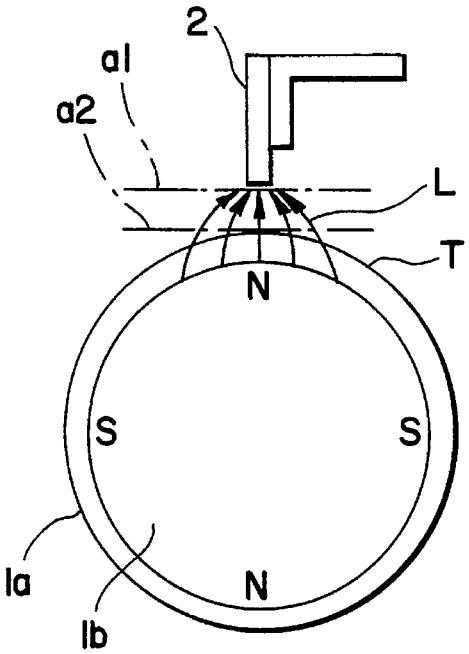
FIG. 2 (PRIOR ART)
FIG. 2 illustrates a major part of the developing machine of FIG. 1.
Figure 3:
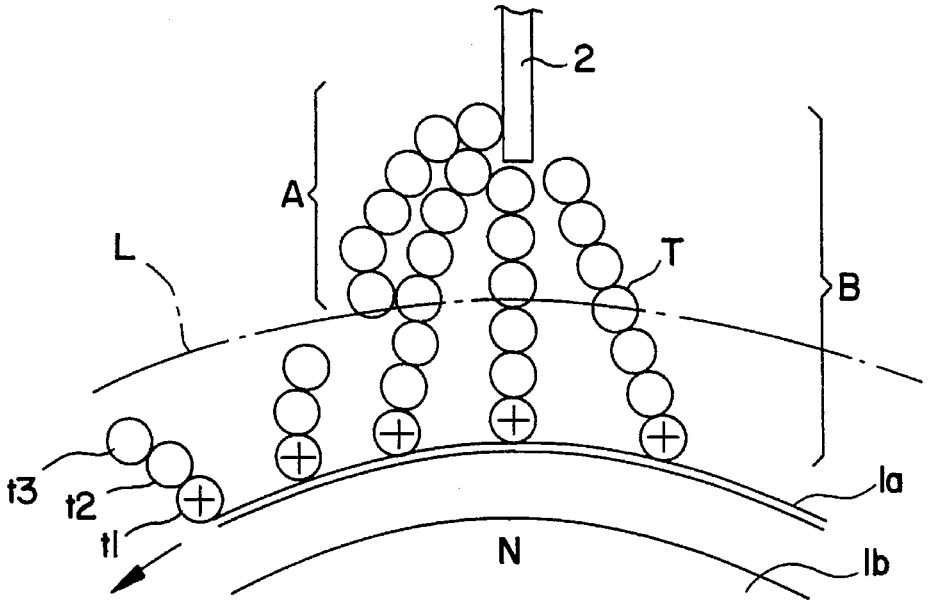
FIG. 3 (PRIOR ART)
FIG. 3 is a sectional view of the machine of FIG. 1, illustrating the operation mechanism.
Figure 10:
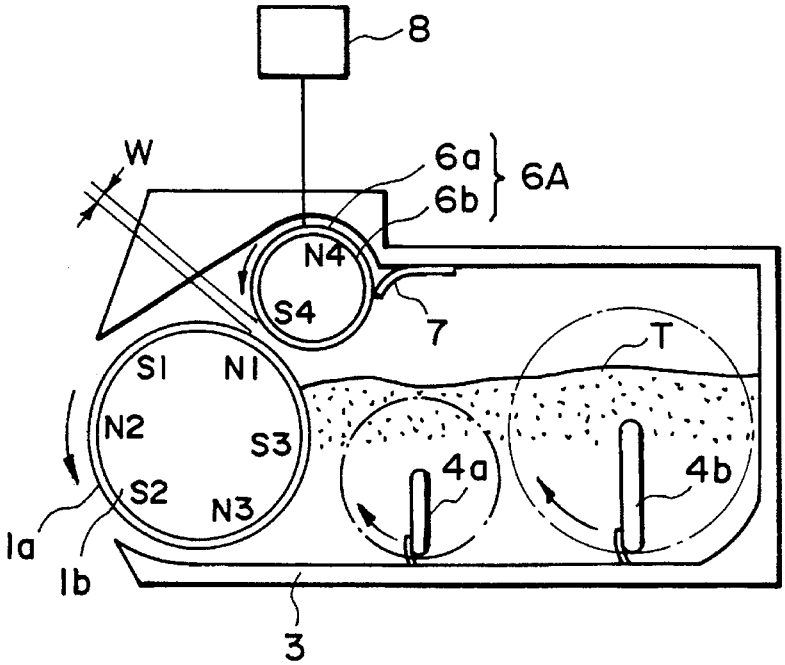
FIG. 10 is a sectional view of a developing apparatus according to a further embodiment of the present invention.

FIG. 10 is a sectional view of a developing apparatus according to a further embodiment of the present invention. This embodiment is a modification of Embodiment 1 of FIG. 4 by providing means 8 for controlling the rotational speed of the developer regulating sleeve 6*a* (speed changeable motor, for example) to control the rotational speed of the sleeve 6*a*, by which the conveying force F2 for the magnetic toner in the first and second layers on the developing sleeve 1*a*, by the regulating member 6*a* is controlled. This embodiment is the same as Embodiment 1 in other respects, and the same reference numerals as in FIG. 1 are assigned in FIG. 10, and the detailed description of them are omitted for simplicity.

As described in the foregoing, when the charge amount distribution of the toner is wide, it becomes difficult in some cases that the structure of the apparatus is determined so as to satisfy inequations (1) and (2).

In this embodiment, as described above, a rotational speed control means 8 is used to control the rotational speed of the sleeve 6*a* by which the conveying force F2 applied from the regulating member 6A to the magnetic toner is finely controlled to satisfy the relations (1i) (F1<F2) and (2) (F2≦F1*s*). By doing so, a necessary and sufficient amount of sufficiently charged toner can be conveyed into the developing zone.

For example, in Embodiment 1, the peripheral speed of the sleeve 6*a* is adjusted to be between 30% and 20% of the peripheral speed of the developing sleeve 1*a*. This makes the adjustment easier.

In FIGS. 8 and 9, the voltage source V2 may be omitted, and in place thereof, the rotational speed of the roller 6*b* or the sleeve 6*a* is adjusted in a similar manner as in FIG. 10.

Embodiment 7

Figure 11:
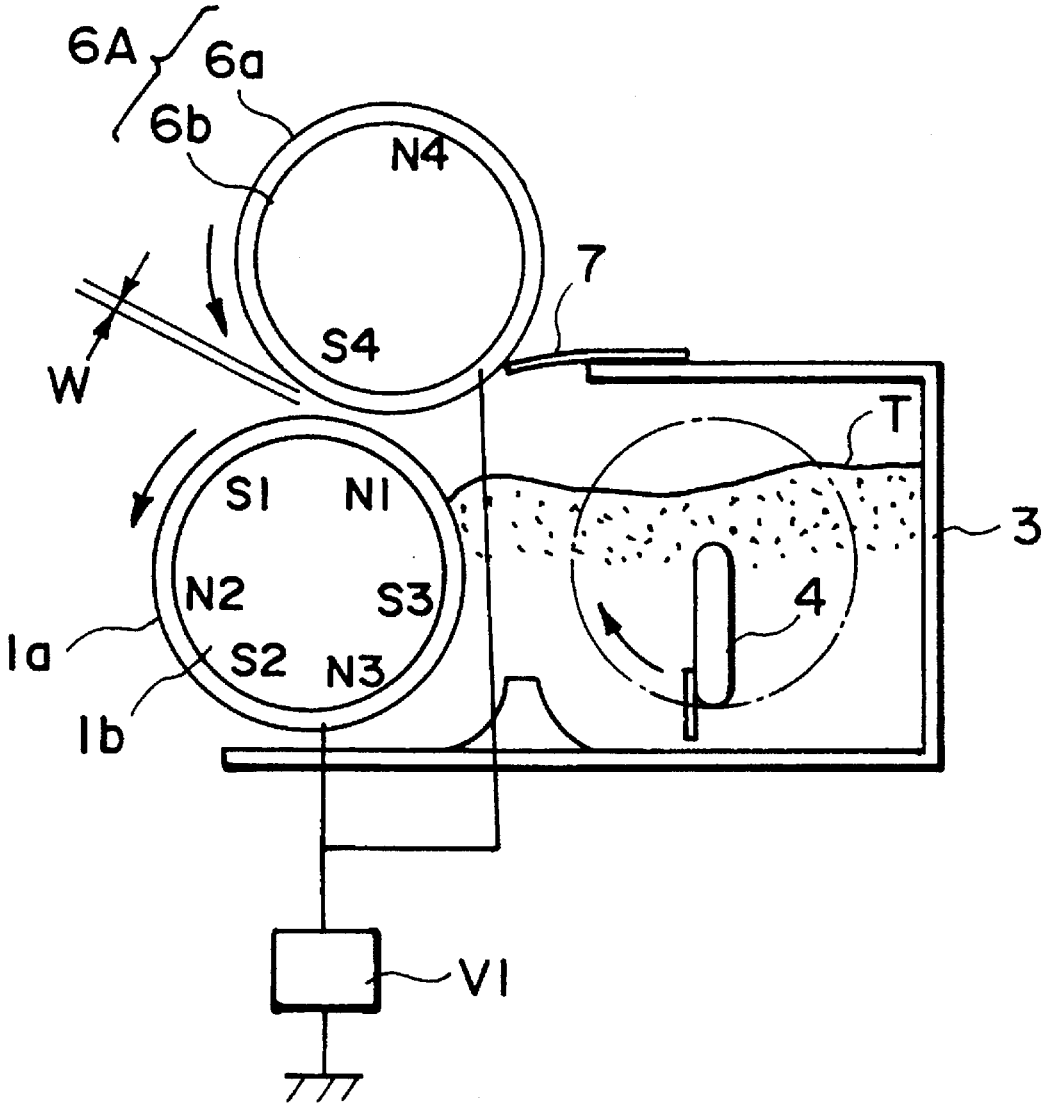
FIG. 11 is a sectional view of a developing apparatus according to a further embodiment of the present invention.

Embodiment 7 is shown in FIG. 11. This embodiment is similar to the embodiment of FIG. 4 except that the positions of the magnetic pules S4 and N1 are deviated from the positional relation described in the foregoing.

More particularly, the magnetic pole S4 is disposed upstream of the position opposing the magnetic pole N1 with respect to the rotational direction of the developing sleeve 6*a*.

Figure 12:
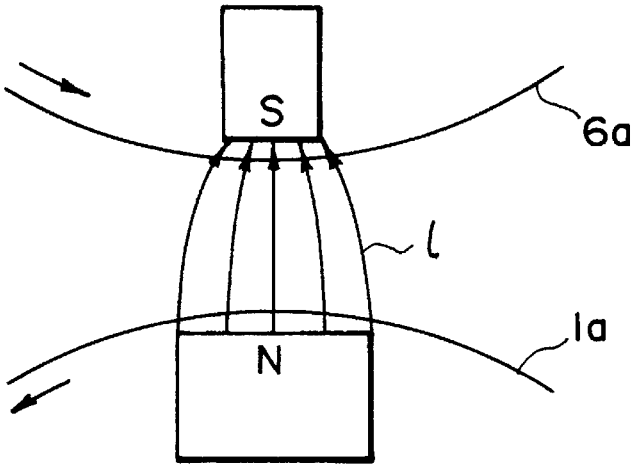
FIG. 12 is a sectional view illustrating magnetic lines of force in the apparatus of the embodiment of FIG. 4.

When the magnetic poles S4 and N1 are opposed to each other as in the FIG. 4 embodiment, the distribution of the magnetic lines of force l is as shown in FIG. 12.

Figure 13:
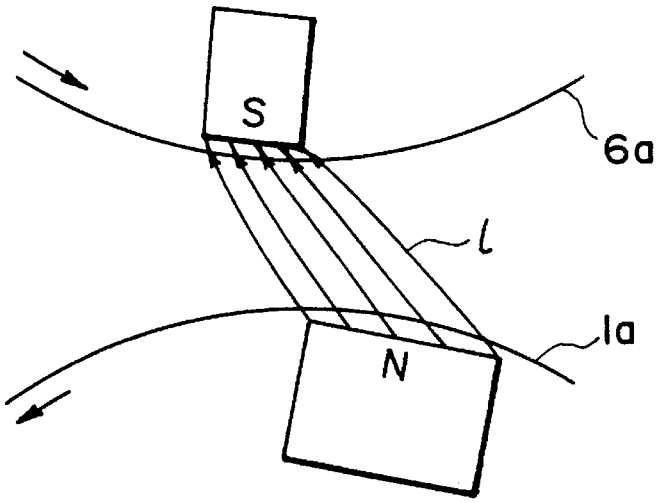
FIG. 13 is a sectional view illustrating magnetic lines of force in the embodiment of FIG. 11.

When the position of the magnetic pole deviated from the position opposing the magnetic pole N1, the distribution of the magnetic lines of force l is as shown in FIG. 13.

As will be understood from comparison between the Figures, FIG. 13 includes a region in which the density of the magnetic lines of force l is more dense than in FIG. 12. Therefore, the magnetic confining force to the toner is stronger than that of FIG. 12, so that the prevention of passage of insufficiently toner particles in enhanced. Accordingly, insufficiently charged magnetic toner is easily pushed back in the direction opposite the toner conveying direction by the developing sleeve 1*a*, by rotation of the regulating sleeve 6*a*.

Embodiment 8

Figure 14:
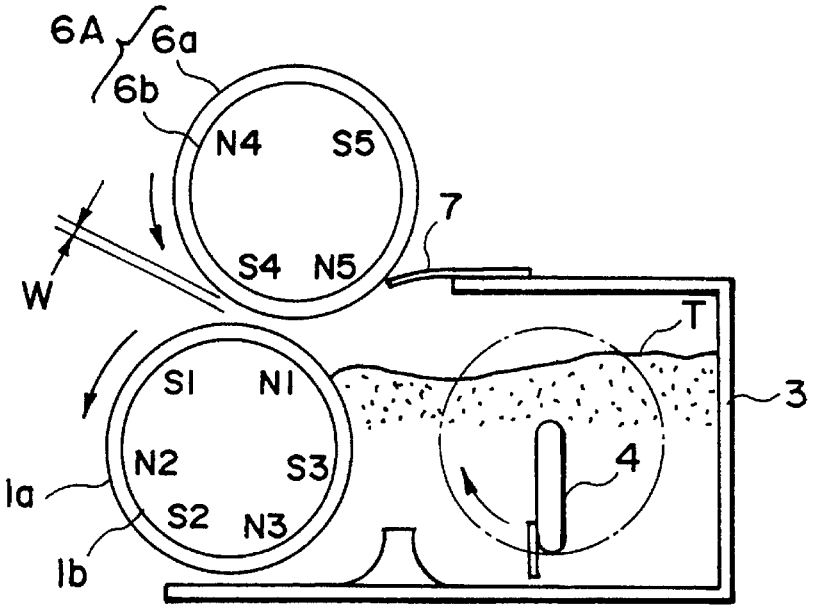
FIG. 14 is a sectional view of a developing apparatus according to a yet further embodiment of the present invention.

Referring now to FIG. 14, this embodiment is similar to the embodiment of FIG. 11 except that the magnet 6*b* has at least one more magnetic pole in addition to the magnetic poles S4 and S4. In this embodiment, the magnet 6*b* has four magnetic poles S4, N4, S5 and N5.

A magnetic pole N5 having a polarity opposite that of magnetic pole S4 is disposed downstream of the magnetic pole S4 with respect to the rotational direction of the sleeve 6.

A part of the magnetic lines of force is connected on the sleeve surface between the magnetic poles N5 and S4, and therefore, the toner particles prevented from passing through the regulating station by the magnetic field between the magnetic poles N1 and S4 and the rotation of the regulating sleeve 6*a*, are easily conveyed in the rotational direction of the regulating sleeve 6*a*.

Embodiment 9

Figure 15:
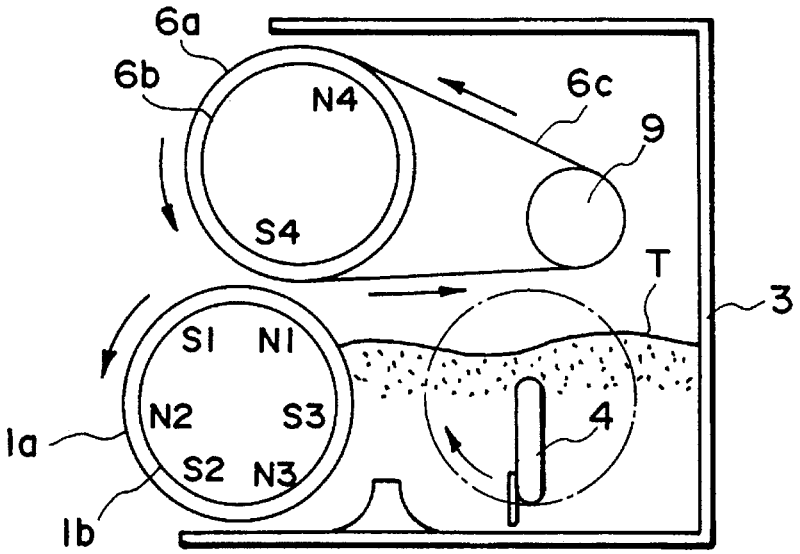
FIG. 15 is a sectional view of a developing apparatus according to a further embodiment of the present invention.

This embodiment is shown in FIG. 15, which is different from the embodiment of FIG. 11 in that a non-magnetic endless belt 6*c* of synthetic resin material or the like is trained on the non-magnetic sleeve 6*a*, and the scraper 7 has been omitted.

The belt 6*c* is trained also around an idling roller 6*a*, and is opposed to the developing sleeve 1*a* at the regulating portion. The belt 6*c* rotates in the direction indicated by arrows by the rotation of the sleeve 6*a*. In this embodiment, the sleeve 6*a* functions as a driving roller for the belt 6*c*. The belt 6*c* has a regulating function which is similar to the function of the regulating sleeve 6*a* in FIG. 11. The toner not having a sufficient amount of electric charge returns into the rear portion in the container 3 on the belt 6*c* by the magnetic force provided by the magnetic pole S4, and separates from the belt 6*c* and falls at a position where the magnetic force of the magnetic pole S4 does not exert an influence thereon.

Figure 7:
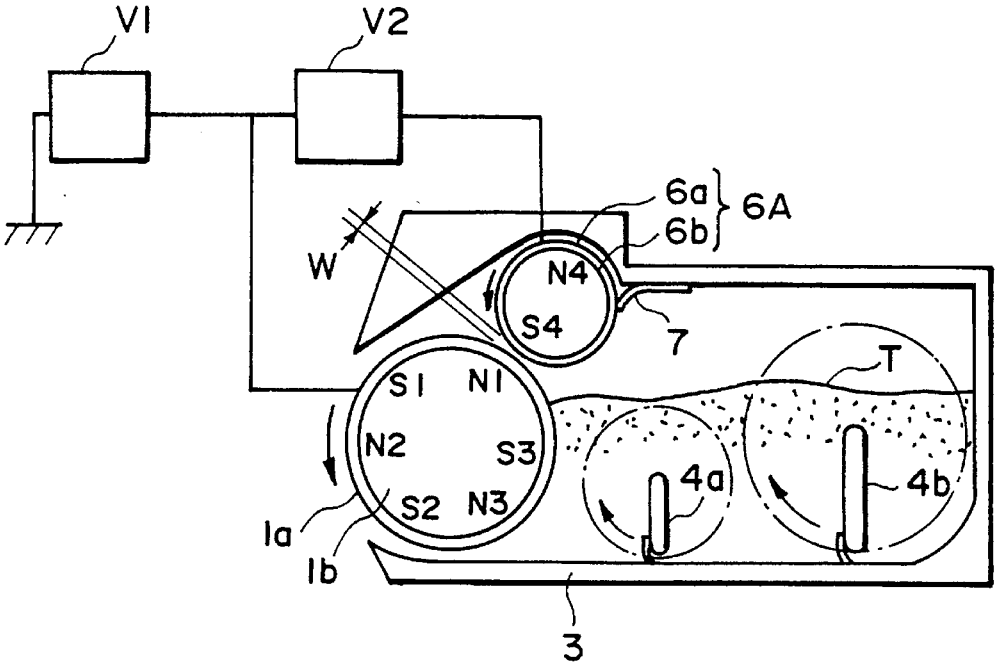
FIG. 7 is a sectional view of a developing apparatus according to another embodiment of the present invention.

The magnetic pole N5 in FIG. 14 or the regulating belt in FIG. 15 can be used in the Embodiments of FIGS. 4, 7 and 10.

The voltage source V2 shown in FIG. 7 or the variable speed motor 7 shown in FIG. 10 is usable in the apparatus of FIG. 11, 14 or In FIGS. 11, 14 and 15, the magnetic pole S4 is disposed at a position deviated toward the upstream side with respect to the rotational direction of the sleeve from the position opposing the magnetic pole N1. However, it may be disposed at a position deviated downstream.

In FIGS. 11, 14 and 15, the magnetic pole N1 is disposed at a position deviated upstream with respect to the rotational direction of the sleeve 1*a* from the closest position between the sleeves 1*a* and 6*a*. This is effective to increase the prevention of passage of insufficiently charged toner. Similarly to FIG. 4, the magnetic pole N1 may be disposed at a position where the sleeves 1*a* and 6*a* are closest.

Embodiment 10

In the above-described embodiment, the toner deposited on the regulating sleeve 6*a* is removed by a scraper 7 contacted to the regulating sleeve 6*a*. Therefore, upon the removing action, the toner is subjected to relatively large mechanical load. This may deteriorate the toner during repeated operation of the apparatus, or cause the binder resin in the toner to be fused on the developing sleeve 6*a*, as the case may be.

Figure 16:
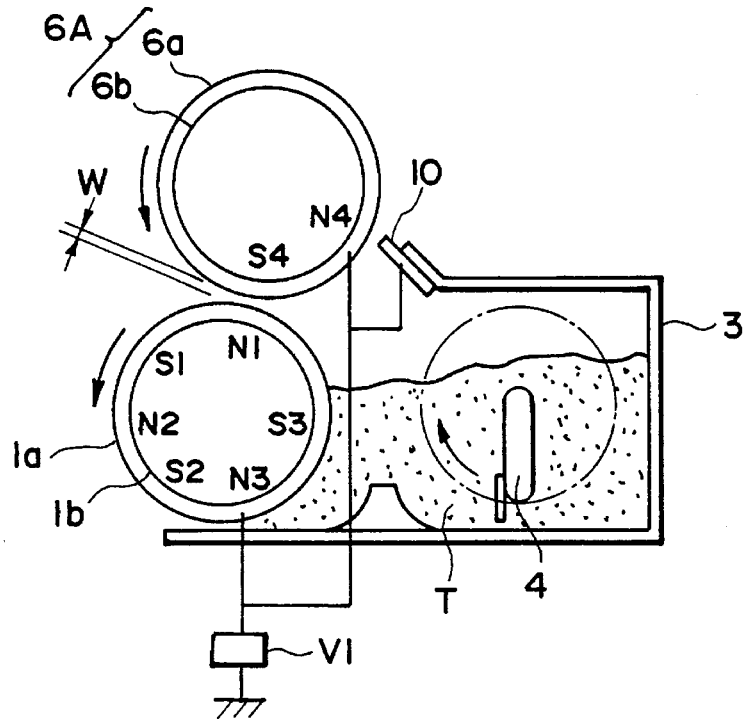
FIG. 16 is a sectional view of a developing apparatus according to a further embodiment of the present invention.

In view of this, in the embodiment of FIG. 16, a magnetic plate 10 of iron or the like which can be magnetized by induction in a magnetic field, is used in place of the scraper 7 in FIG. 4, and is disposed opposed to the developing sleeve 6*a* with a gap therebetween at a position downstream of the magnetic pole S1 with respect to the rotational direction of the regulating sleeve 6*a*. The gap between the magnetic plate 10 and the regulating sleeve 6*a* is larger than the weight average particle size of the toner, and is 20–400 μm, preferably.

In this embodiment, the magnetic pole N4 is disposed at a position deviated upstream of the position shown in FIG. 4 with respect to the rotational direction of the sleeve 6*a*, and the magnetic plate 10 is disposed opposed to the magnetic pole N4. It is preferable in order to prevent the charging that the magnetic plate 10 is supplied with the same bias voltage as the sleeve 6*a*.

The magnetic plate 10 is magnetized in the magnetic field provided by the magnetic pole N4, so that a strong magnetic field is formed therebetween. This magnetic field prevents passage of the magnetic toner coming by the rotation of the regulating sleeve 6*a* through the gap between the magnetic plate 10 and the sleeve 6*a*, so that the magnetic toner is removed from the sleeve 6*a*.

The width of the magnetic plate 10 is preferably smaller than the width of the 50% level width of the magnetic pole N4. By doing so, the magnetic lines of force are concentrated from the magnetic pole N4 to the tip end of the magnetic plate 10, and therefore, the removal efficiency of the magnetic toner from the sleeve 6*a* is improved.

Embodiment 11

Figure 17:
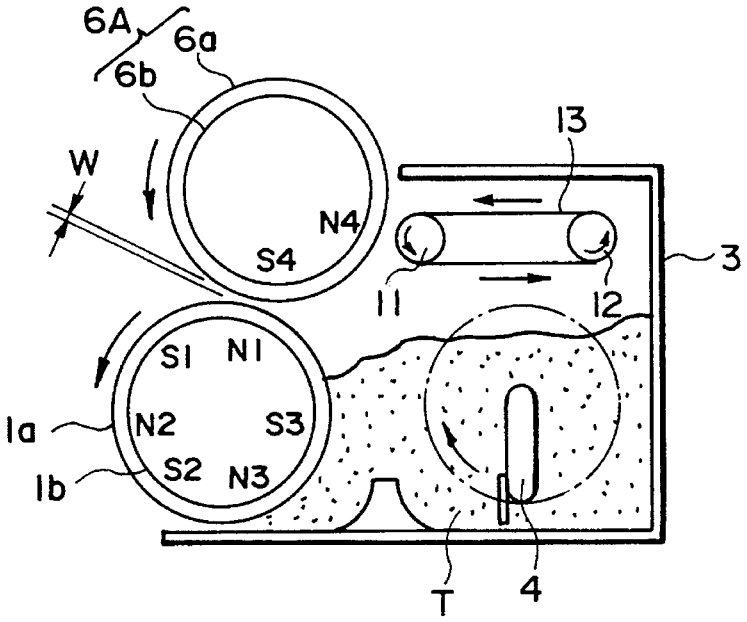
FIG. 17 is a sectional view of a developing apparatus according to a further embodiment of the present invention.

Embodiment 11 is shown in FIG. 17 and is a modification of the embodiment FIG. 16 by using scraping means comprising members 11, 12 and 13 in place of the scraping member 10 in FIG. 16.

The member 11 is in the form of a magnetic roller of iron or the like which is magnetized by induction in a magnetic field. The roller 11 is disposed opposed to the magnetic pole N4. The diameter of the roller 11 is preferably smaller than the 50% level width of the magnetic pole N4. By doing so, the magnetic field provided by the magnetic pole N4 is more strongly concentrated on the magnetic roller 11. The member 12 is a driving roller, and between the driving roller 12 and the magnetic roller 11, an endless belt 13 of non-magnetic material such as synthetic resin or the like, is trained. The belt 13 is faced to the regulating speed 6*a* with a small clearance therebetween. By rotation of the driving roller 12 in the direction indicated by an arrow, the belt 11 is rotated such that the surface thereof moves in the direction opposite the direction in which the surface of the sleeve 6*a* moves, at a position where it is faced to the sleeve 6*a* (toner scraping position). The magnetic material roller 11 follows the belt 13 to rotate in the same direction as the sleeve 6*a*.

The magnetic toner carried on the regulating sleeve 6*a* to the scraping position, is prevented from passage by the magnetic field created between the magnetic pole N4 and the magnetic material member 11, and is removed from the sleeve 6*a* by the rotation of the belt 13.

The toner removed from the sleeve 6*a* is deposited on the belt 13 and is conveyed to a rear side of the container, and falls from the belt 13 at a position where the magnetic field from the magnetic pole N4 becomes week enough.

Embodiment 12

Figure 18:
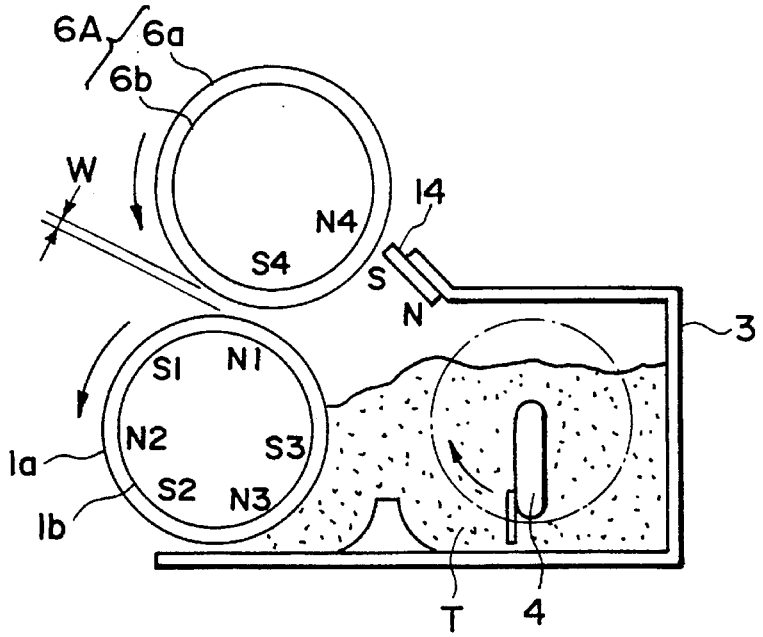
FIG. 18 is a sectional view of a developing apparatus according to a further embodiment of the present invention.

This embodiment is shown in FIG. 18 and is a modification of the embodiment of FIG. 16 by using a permanent magnet 14 in place of the magnetic material member 10.

An S magnetic pole of the magnet 14, which is opposite that of the N4 pole, is disposed opposed to the magnetic pole N4, and a magnetic field is formed between the magnetic pole N4 and the magnetic pole S to remove the toner from the sleeve 6*a*.

Embodiment 13

Figure 19:
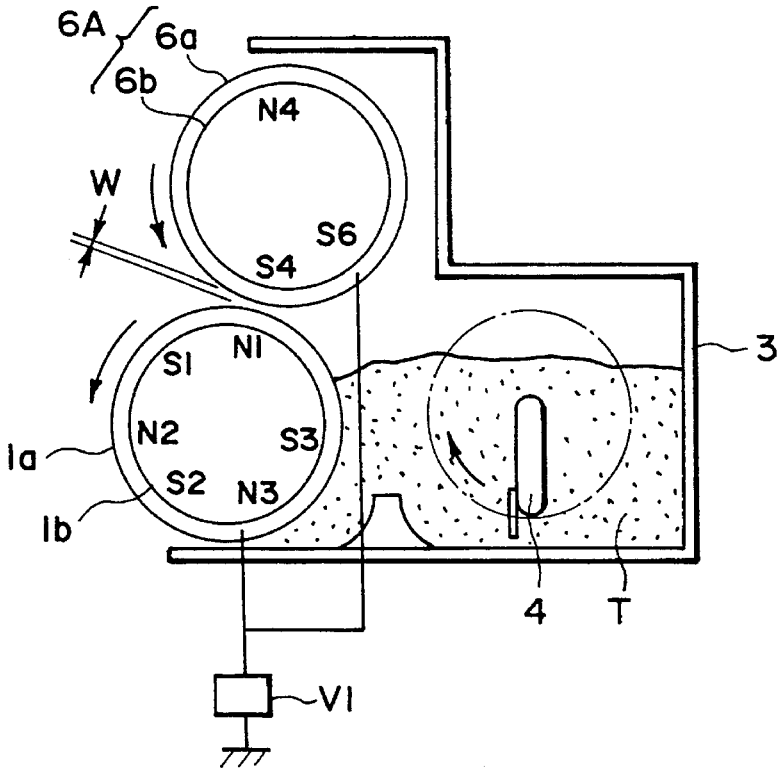
FIG. 19 is a sectional view of a developing apparatus according to a further embodiment of the present invention.

This embodiment is shown in FIG. 19 and is a modification of the embodiment of FIG. 16 by omitting the magnetic material member 10 and using the magnet 6*b* of the regulating member 6A to form a repelling magnetic field. More particularly, adjacent to the magnetic pole S4, the magnet 6*b* has a magnetic pole S6 of the same polarity as the magnetic pole S4 at a position downstream of the magnetic pole S4 with respect to the rotational direction of the regulating sleeve 6*a*.

In this manner, between the magnetic poles S4 and S6 a so-called repelling magnetic field in which the magnetic lines of force are not continuous between the magnetic poles, is formed.

The repelling magnetic field is effective to remove the magnetic toner from the sleeve 6*a*, and therefore, the toner on the sleeve not passing through the regulating station is removed from the sleeve 6*a* by the repelling magnetic field.

In this embodiment, between the magnetic pole S4 for regulation and the magnetic pole S6, the magnetic lines of force are not continuous. Therefore, the magnetic flux density between the magnetic poles N1 and S4 is increased, so that the prevention of passage of insufficiently charged toner is enhanced.

Embodiment 14

Figure 20:
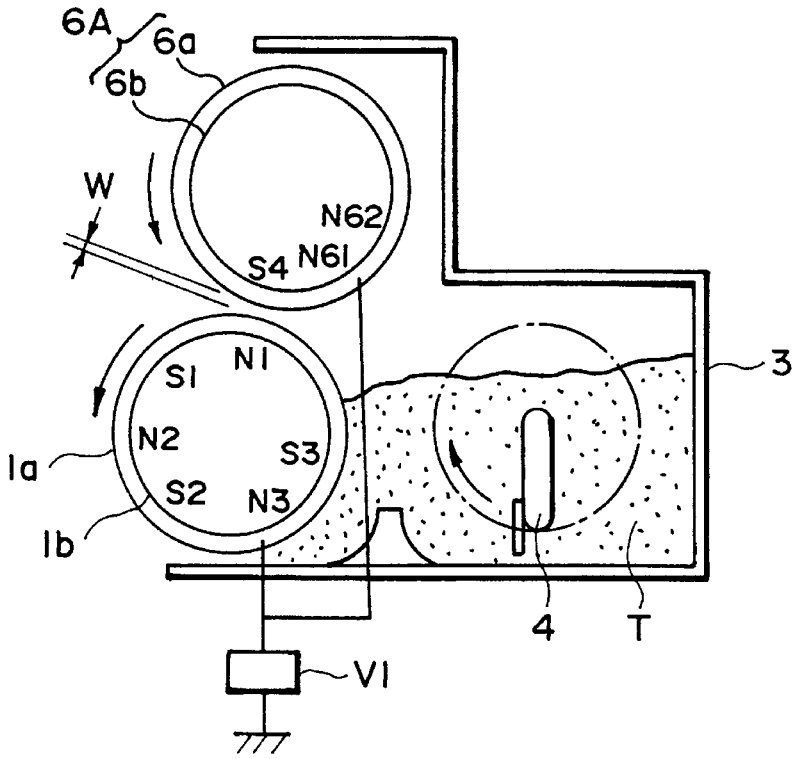
FIG. 20 is a sectional view of a developing apparatus according to a further embodiment of the present invention.

This embodiment is shown in FIG. 20, in which the repelling magnetic field is also used to remove the toner from the regulating sleeve 6*a*. However, in this embodiment, there are provided magnetic poles N61 and N62 in the magnet 6*b* of the regulating means. The magnetic poles N61 and N62 are of the same polarity and adjacent to each other at a position downstream of the regulating magnetic pole S4 with respect to the rotational direction of the sleeve 6*a*.

The repelling magnetic field formed between the magnetic poles N61 and N62 functions to separate the magnetic toner coming from the regulating position on the sleeve 6*a*, from the sleeve 6*a*.

The regulating magnetic pole S4 and the adjacent magnetic pole N16, are of opposite polarities from each other. Therefore, a part of the magnetic lines of force are continuous on the sleeve 6*a* between the magnetic poles S4 and N61. Accordingly, the magnetic toner having been prevented from passing through the regulating position can easily move in the rotational direction of the sleeve 6*a* from the regulating position, and therefore, stagnation of the toner at the regulating position can be prevented. By doing so, it becomes easy that only the sufficiently charged toner is conveyed into the developing zone.

Embodiment 15

Figure 21:
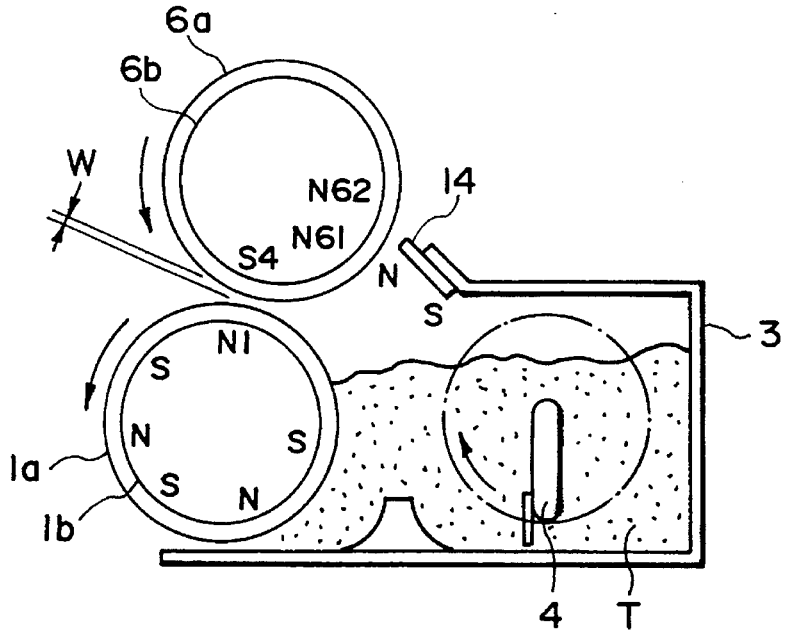
FIG. 21 is a sectional view of a developing apparatus according to a further embodiment of the present invention.

This embodiment is shown in FIG. 21, and is a modification of the embodiment of FIG. 20 by disposing the N pole of a permanent magnetic plate 14 between the magnetic poles N61 and N62.

Between the plate 14 and the sleeve 6*a*, a fine gap is provided.

As described, since the three magnetic poles N61, N62 and N are of the same polarity, a stronger magnetic force than the Embodiment of FIG. 21 can be provided. Therefore, the magnetic toner conveyed on the surface of the developer regulating member 6A receives a strong magnetic force in the direction of removal from the surface of the developer regulating member 6A, even if the toner is electrically charged to a certain extent and has cohesive force. Therefore, the insufficiently charged magnetic toner on the surface of the developer regulating member 6A and the magnetic toner charged to a certain extent and the magnetic toner having larger cohesive force, can be reliably removed without contact from the surface of the developer regulating member 6A by the strong repelling force.

Embodiment 16

In the embodiments of FIGS. 16–21, the toner is removed from the sleeve 6*a* without use of a member contacting the regulating sleeve 6*a*, and therefore, the mechanical stress applied to the toner is small. For this reason, the effect of preventing the toner fusing on the sleeve 6*a* or the effect of preventing toner deterioration are enhanced.

Figure 22:
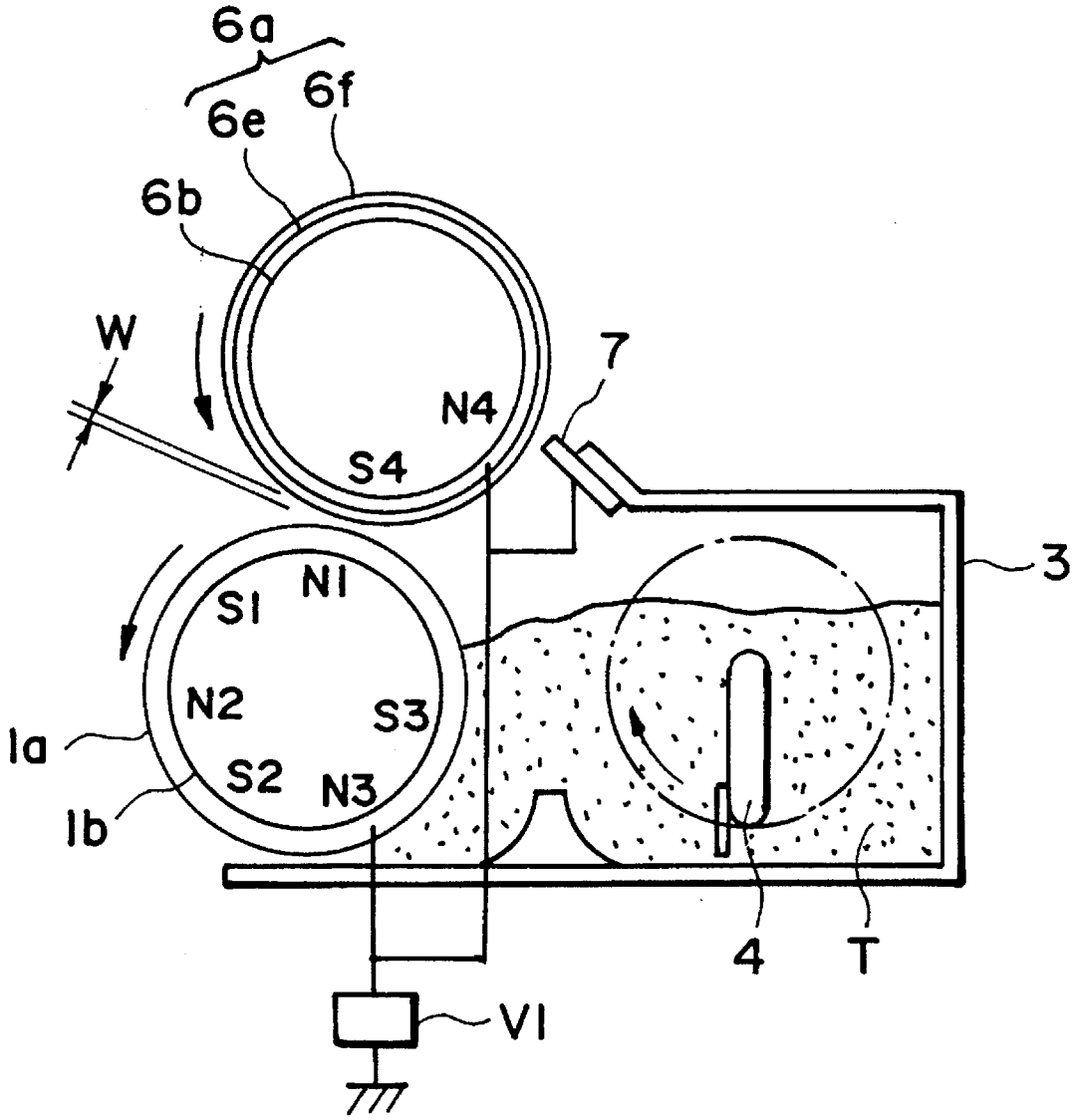
FIG. 22 is a sectional view of a developing apparatus according to a further embodiment of the present invention.

However, with the non-contact structure, a small amount of the toner passes through the removing station while being deposited on the regulating sleeve 6*a*, with the result that it enters the regulating station in a direction opposite from the toner conveying direction by the developing sleeve 1*a*. A significant factor of the deposition of the toner on the sleeve 6*a* is the small amount of electric charge of the toner. In the embodiment of FIG. 22, in order to prevent the above-described phenomenon, the regulating sleeve 6*a* of FIG. 16 is replaced with a sleeve 6*a* comprising a non-magnetic metal cylinder 6*e* coated with a thin surface layer 6*f* of a material effective to suppressing triboelectric charging of the toner.

The toner is charged by the friction with the developing sleeve 1*a* to a polarity effective to develop the latent image.

The material of the surface layer is such that it is triboelectrically charged to the same polarity as the toner by friction with the developing sleeve 1*a*.

When the toner is charged to a negative polarity by friction or rubbing with the developing sleeve 1*a* of aluminum, the surface layer 6*f* is constituted of a fluorine resin material which is charged to a negative polarity by friction with the aluminum developing sleeve 1*a*.

When the toner is charged to a positive polarity by friction with the aluminum sleeve 1*a*, the surface layer 6*f* is constituted of a acrylic resin material or nylon resin material which is charged to a positive polarity by friction with the aluminum sleeve 1*a*.

In any case, such a surface layer 6*f* provided on the regulating sleeve 6*a*, the triboelectric charge of the toner by contact with the regulating sleeve 6*a* can be suppressed to a small amount, and therefore, the electrostatic deposition force of the toner to the regulating sleeve 64 can be controlled to be small.

Therefore, the toner removing effect from the sleeve 6*a* is enhanced by the scraping member 7 out of contact with the sleeve 6*a*.

The surface layer 6*f* can be provided on the regulating sleeve 6*a* of any of the embodiments of FIGS. 17–21, for the same purpose.

In any one of the embodiments of FIGS. 16–22, the magnetic pole S4 may be disposed at a position deviated from a position opposing the magnetic pole N1, similarly to FIGS. 11 and 13. In the embodiment of FIGS. 11–22, the voltage of the voltage source V2 similar to that shown in FIG. 7, may be applied to the regulating sleeve.

In any of the foregoing embodiments, the N poles and S poles may be exchanged with each other.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing an electrostatic latent image, comprising:

a container for containing one component magnetic developer;

a rotatable developer carrying member for carrying a layer of developer from said container to a developing zone for developing the electrostatic latent image, said rotatable developer carrying member having a peripheral rotation direction;

a rotatable regulating member, disposed opposed to said developer carrying member in a regulating zone, for reducing a thickness of the layer of developer carried to the developing zone by said developer carrying member, to a predetermined thickness, said rotatable regulating member having a peripheral rotation direction that is opposite the peripheral rotation direction of said rotatable developer carrying member in the regulating zone;

a first stationary magnet disposed in said rotatable developer carrying member and including a first magnetic pole located at the regulating zone and having a polarity; and a second stationary magnet disposed in said rotatable regulating member and including a second magnetic pole having a polarity opposite the polarity of the first magnetic pole, whereby said first and second magnets cooperate to form a magnetic field in the regulating zone;

wherein a relation $F1s \geqq F2 > F1$ is satisfied, where $F1s$ is a conveying force applied by said developer carrying member to a first portion of the layer of developer contacting a surface of said developer carrying member, F1 is a conveying force applied by said developer carrying member to a second portion of the layer of developer formed on the first portion of the layer of developer, and F2 is a conveying force applied by said regulating member to developer in the first and second portions of the layer of developer.

2. A developing apparatus according to claim 1, wherein a 50% magnetic flux density level width of the second magnetic pole is smaller than a 50% magnetic flux density level width of the first magnetic pole.

3. An apparatus according to claim 1 or 2, wherein the second magnetic pole is opposed to the first magnetic pole.

4. An apparatus according to claim 3, wherein the first magnetic pole is disposed upstream of a position where said regulating member is closest to said developer carrying member with respect to a rotational direction of said developer carrying member.

5. An apparatus according to claim 3, wherein said first magnetic pole is disposed at a position where said regulating member is closest to said developer carrying member.

6. An apparatus according to claim 1 or 2, wherein said second magnetic pole is deviated from a position opposing said first magnetic pole.

7. An apparatus according to claim 6, wherein the first magnetic pole is disposed upstream of a position where said regulating member is closest to said developer carrying member with respect to a rotational direction of said developer carrying member.

8. An apparatus according to claim 6, wherein said first magnetic pole is disposed at a position where said regulating member is closest to said developer carrying member.

9. An apparatus according to claim 1 or 2, wherein said second stationary magnet is disposed downstream of the first magnetic pole with respect to the rotational direction of said regulating member, and comprises a third magnetic pole adjacent the second magnetic pole, said third magnetic pole having a polarity that is the same as the polarity of the second magnetic pole.

10. An apparatus according to claim 9, wherein said regulating member includes a surface layer chargeable to the same polarity as a charging polarity of the developer by friction with said developer carrying member.

11. An apparatus according to claim 1 or 2, wherein said second stationary magnet comprises third, fourth and fifth magnetic poles sequentially arranged downstream of the second magnetic pole with respect to the peripheral rotational direction of said regulating member, wherein the third magnetic pole is adjacent the second magnetic pole, the fourth magnetic pole is adjacent the third magnetic pole, and the fifth magnetic pole is adjacent the fourth magnetic pole, and wherein the third magnetic pole has a polarity opposite the polarity of the second magnetic pole, and the fourth and fifth magnetic poles have a polarity that is the same as the polarity of the second magnetic pole.

12. An apparatus according to claim 11, wherein said regulating member includes a surface layer chargeable to the same polarity as a charging polarity of the developer by friction with said developer carrying member.

13. An apparatus according to claim 1 or 2, wherein said second stationary magnet comprises a third magnetic pole downstream of the second magnetic pole with respect to the peripheral rotational direction of the regulating member, said apparatus further comprising a developer removing member disposed in a magnetic field of the first magnetic pole with a gap formed between said developer removing member and said regulating member.

14. An apparatus according to claim 13, wherein said developer removing member comprises a magnetic member magnetized by a magnetic field of the third magnetic pole.

15. An apparatus according to claim 13, wherein said developer removing member includes a permanent magnet having a permanent magnetic pole of a polarity opposite the polarity of the third magnetic pole, and disposed opposed to the third magnetic pole.

16. An apparatus according to claim 13, wherein said regulating member includes a surface layer chargeable to the same polarity as a charging polarity of the developer by friction with said developer carrying member.

17. An apparatus according to claim 1 or 2, further comprising means for applying, to said rotatable regulating member, a voltage for urging the developer toward said developer carrying member.

18. An apparatus according to claim 1 or 2, further comprising means for changing a rotational speed of said rotatable regulating member.

19. A developing apparatus for developing an electrostatic latent image, comprising:

a container for containing one component magnetic developer;

a rotatable developer carrying member for carrying developer from said container to a developing zone for developing the electrostatic latent image;

a first stationary magnet disposed in said developer carrying member and comprising a first magnetic pole;

regulating means for regulating a layer of developer to be carried to the developing zone by said developer carrying member, wherein said regulating means comprises a rotatable regulating member, disposed opposite said developer carrying member with a gap therebetween and in contact with developer carried on said developer carrying member at a regulating zone, said rotatable regulating member being rotatable in the same direction as said developer carrying member; and a second stationary magnet disposed in said rotatable regulating member, wherein said second stationary magnet includes a second magnetic pole of a polarity opposite that of the first magnetic pole of said first stationary magnet, the first and second magnetic poles cooperating to form a magnetic field in said gap;

wherein a 50% magnetic flux density level width of the second magnetic pole is smaller than a 50% magnetic flux density level width of the first magnetic pole.

20. An apparatus according to claim 19, wherein said second magnetic pole is disposed opposite the first magnetic pole.

21. An apparatus according to claim 20, wherein the first magnetic pole is disposed upstream of a position where said regulating member is closest to said developer carrying member with respect to a rotational direction of said developer carrying member.

22. An apparatus according to claim 20, wherein said first magnetic pole is disposed at a position where said regulating member is closest to said developer carrying member.

23. An apparatus according to claim 19, wherein said second magnetic pole is deviated from a position opposing to said first magnetic pole.

24. An apparatus according to claim 23, wherein the first magnetic pole is disposed upstream of a position where said regulating member is closest to said developer carrying member with respect to a rotational direction of said developer carrying member.

25. An apparatus according to claim 23, wherein said first magnetic pole is disposed at a position where said regulating member is closest to said developer carrying member.

26. An apparatus according to any of claims 19–25, wherein said second stationary magnet is disposed downstream of the first magnetic pole with respect to the rotational direction of said regulating member, and comprises a third magnetic pole adjacent the second magnetic pole, said third magnetic pole having a polarity that is the same as the polarity of the second magnetic pole.

27. An apparatus according to any one of claims 19–25, wherein said second magnet comprises third, fourth and fifth magnetic poles sequentially arranged downstream of the second magnetic pole with respect to the rotational direction of said regulating member, wherein the third magnetic pole is adjacent to the second magnetic pole, the fourth magnetic pole is adjacent to the third magnetic pole, and the fifth magnetic pole is adjacent to the fourth magnetic pole, and wherein the third magnetic pole is of a polarity opposite from the second magnetic pole, and the fourth and fifth magnetic poles are of the same polarity as the second magnetic pole.

28. An apparatus according to any one of claims 19–25, wherein said second stationary magnet comprises a third magnetic pole downstream of the second magnetic pole with respect to the rotational direction of the regulating member, said apparatus further comprising a developer removing member disposed in a magnetic field of the first magnetic pole with a gap formed between said developer removing member and said regulating member.

29. An apparatus according to claim 28, wherein said developer removing member comprises a magnetic member magnetized by a magnetic field of the third magnetic pole.

30. An apparatus according to claim 28, wherein said developer removing member includes a permanent magnet having a permanent magnetic pole of a polarity opposite that of the third magnetic pole, disposed opposite the third magnetic pole.

* * * * *

UNITED STATES PATENT AND TRADEMARK OFFICE

CERTIFICATE OF CORRECTION

PATENT NO. : 5,517,286

DATED : May 14, 1996

INVENTOR(S) : TATSUYA TADA, et al.

It is certified that error appears in the above-indentified patent and that said Letters Patent is hereby corrected as shown below:

COLUMN 1

Line 20, "FIG. 10" should read --FIG. 1,--.
Line 29, "disposed stationarily." should read --disposed.--.
Line 33, "magnetic-poles" should read --magnetic poles--.
Line 46, "that" should read --so that--.

COLUMN 2

Line 16, "by the" should read --by--.
Line 50, "The" should read --the--.

COLUMN 4

Line 50, "pale should read --pole--.

COLUMN 5

Line 20, "produce" should read --produced--.

COLUMN 6

Line 16, "inequations" should read --equations--.
Line 43, "inequations" should read --equations--.
Line 51, "The" should read --the--.
Line 60, "inequation" should read --equation--.
Line 62, "inequation" should read --equation--.

UNITED STATES PATENT AND TRADEMARK OFFICE

CERTIFICATE OF CORRECTION

PATENT NO. : 5,517,286

DATED : May 14, 1996

INVENTOR(S) : TATSUYA TADA, et al.

It is certified that error appears in the above-indentified patent and that said Letters Patent is hereby corrected as shown below:

COLUMN 7

Line 39, "roller 5D" should read --roller 6D--.
Line 66, "radiating" should read --regulating--.

COLUMN 8

Line 20, "plate 6D" should read --plate 6b--.
Line 27, "plate 6D" should read --plate 6b--.
Line 58, "enhanced." should read --is enhanced.--.

COLUMN 9

Line 5, "charged with the" should read --charged by--.
Line 53, "confirm" should read --confirmed--.

COLUMN 10

Line 10, "are" should read --is--.
Line 15, "inequations" should read --equations--.
Line 20, "(1i)" should read --(1)--.

COLUMN 11

Line 20, "roller 6a," should read --roller 9,--.
Line 37, "14 or" should read --14 or 15.--.

COLUMN 12

Line 30, "embodiment" should read --embodiment of--.
Line 60, "week" should read --weak--.

UNITED STATES PATENT AND TRADEMARK OFFICE

CERTIFICATE OF CORRECTION

PATENT NO. : 5,517,286

DATED : May 14, 1996

INVENTOR(S) : TATSUYA TADA, et al.

It is certified that error appears in the above-indentified patent and that said Letters Patent is hereby corrected as shown below:

COLUMN 14

Line 49, "a" should read --an--.
Line 56, "sleeve 64" should read --sleeve 6a--.

COLUMN 17

Line 37, "to" should be deleted.

COLUMN 18

Line 4, "any" should read --any one--.

Signed and Sealed this

First Day of October, 1996

Bruce Lehman

*Attest:*

BRUCE LEHMAN

*Attesting Officer*

*Commissioner of Patents and Trademarks*